US006520086B1

(12) United States Patent
Newington et al.

(10) Patent No.: US 6,520,086 B1
(45) Date of Patent: Feb. 18, 2003

(54) PRINTING PLATES AND A METHOD FOR THEIR PREPARATION

(75) Inventors: Ian M. Newington, Bucks (GB); Trevor J. Wear, Middx (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/856,721

(22) PCT Filed: Dec. 14, 1999

(86) PCT No.: PCT/GB99/04238

§ 371 (c)(1),
(2), (4) Date: May 24, 2001

(87) PCT Pub. No.: WO00/37261

PCT Pub. Date: Jun. 29, 2000

(30) Foreign Application Priority Data

Dec. 22, 1998 (GB) ..... 9828154

(51) Int. Cl.[7] ..... B41N 1/14; B41C 1/10

(52) U.S. Cl. ..... 101/457; 101/462; 101/466; 347/96; 347/105

(58) Field of Search ..... 101/457, 462, 101/463.1, 465, 466, 467; 430/302; 347/95, 96, 100, 101, 105

(56) References Cited

U.S. PATENT DOCUMENTS

| | | | | | |
|---|---|---|---|---|---|
| 5,213,041 | A | | 5/1993 | Kanck | 101/467 |
| 5,820,932 | A | * | 10/1998 | Hallman et al. | 101/463.1 |
| 5,913,972 | A | * | 6/1999 | Kanou et al. | 106/31.87 |
| 6,071,675 | A | * | 6/2000 | Teng | 101/452 |
| 6,187,380 | B1 | * | 2/2001 | Hallman et al. | 101/457 |
| 6,276,273 | B1 | * | 8/2001 | Aurenty et al. | 101/457 |
| 6,321,652 | B1 | * | 11/2001 | Fujinami et al. | 101/465 |

FOREIGN PATENT DOCUMENTS

| | | | |
|---|---|---|---|
| EP | 0 616 017 A2 | | 9/1994 |
| EP | 640875 | * | 3/1995 |

* cited by examiner

*Primary Examiner*—Stephen R. Funk

(57) ABSTRACT

A method for the preparation of a lithographic printing plate comprises forming an oleophilic image on the surface of a hydrophilic support by depositing, preferably by ink-jetting, the image on the surface using an aqueous dispersion of an oligomer having in the molecule both hydrophilic and hydrophobic groups. The number of repeating units in the oligomer may be from 2 to 10 and the number of hydrophilic groups in the oligomer may also be from 2 to 10. Preferably the molecular weight of the oligomer is from about 500 to about 5000.

7 Claims, 1 Drawing Sheet

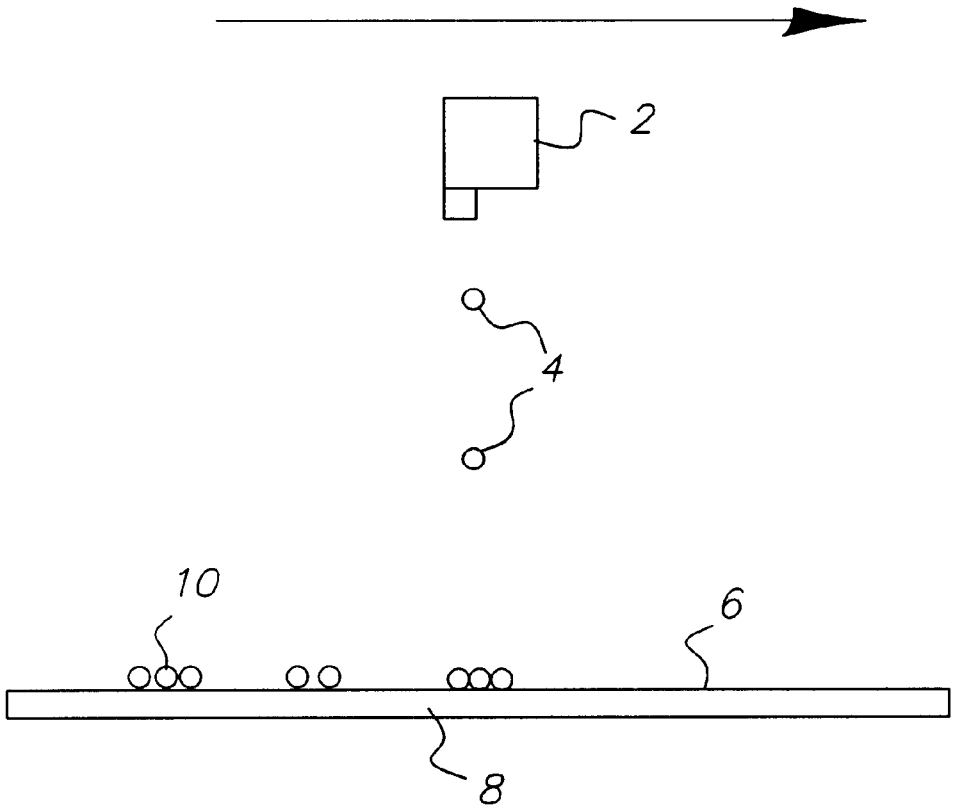
2
4
10
6
8

PRINTING PLATES AND A METHOD FOR THEIR PREPARATION

FIELD OF THE INVENTION

This invention relates to novel printing plates, to a method for their preparation and to a lithographic printing process employing the plates.

BACKGROUND OF THE INVENTION

Printing plates suitable for offset lithographic printing are known which comprise a support having non-image areas which are hydrophilic and image areas which are hydrophobic and ink-receptive.

The art of lithographic printing is based upon the immiscibility of oil and water, wherein the oily material or ink is preferentially retained by the image area and water or fountain solution is preferentially retained by the non-image area. When a suitably prepared surface is moistened with water and an ink is then applied the background or non-image area retains the water and repels the ink while the image area accepts the ink and repels the water. The ink on the image area is then transferred to the surface of a material upon which the image is to be reproduced, such as paper, cloth and the like. Commonly the ink is transferred to an intermediate material called the blanket which in turn transfers the ink to the surface of the material upon which the image is to be reproduced.

Ink-jetting is the non-impact method for producing images by the deposition of ink droplets on a substrate in response to digital signals. JP-A-53015905 describes the preparation of a printing plate by ink-jetting an alcohol-soluble resin in an organic solvent onto an aluminum printing plate. JP-A-56105960 describes the formation of a printing plate by ink-jetting onto a support e.g. an anodised aluminum plate an ink capable of forming an oleophilic image and containing a hardening substance such as epoxy-soybean oil together with benzoyl peroxide or a photo-hardening substance such as an unsaturated polyester.

European Patent Application No. 882584 describes a method of preparing a printing plate comprising producing an oleophilic image on the surface of a support by ink-jet printing the image on the surface using an aqueous solution or of a salt of a hydrophobic organic acid e.g. oleic acid. G.B. Patent Application No. 2,332,646 describes a method of preparing a printing plate comprising producing an oleophilic image on the surface of a support by ink-jet printing the image on the surface using an aqueous solution or aqueous colloidal dispersion of a polymer bearing water-solubilising groups wherein the water-solubilising groups interact with the surface of the support thereby binding the polymer to the support and rendering the polymer insoluble.

Problem to be Solved by the Invention

The prior art methods involve the use of organic solvents or photo-hardenable compounds or polymers which introduces some risk that the inlets may become blocked by the polymer.

A solution to these problems has now been invented in which an oligomer having hydrophilic and hydrophobic groups in the molecule, is used as an aqueous dispersion to prepare the image on the printing plate.

SUMMARY OF THE INVENTION

According to the present invention a method for the preparation of a lithographic printing plate comprises forming an oleophilic image on the surface of a hydrophilic support by depositing, preferably by ink-jetting, the image on the surface using an aqueous dispersion of an oligomer having in the molecule both hydrophilic and hydrophobic groups.

Advantageous Effect of the Invention

The method of the invention offers a rapid, simple and direct way to make a printing plate from digital data using relatively low cost equipment and without light sensitive materials.

Compared with the methods disclosed in the prior art, the method of the invention requires no processing of the plate and uses dilute aqueous dispersions having a low level of environmental impact and low health risk. In addition the risk of the jets being blocked by polymer is reduced.

BRIEF DESCRIPTION OF THE DRAWINGS

The drawing is a sketch showing the formation of a printing plate by ink-jetting.

DETAILED DESCRIPTION OF THE INVENTION

The oligomer may be applied as an aqueous solution or an aqueous emulsion.

The term aqueous is intended to include the optional presence of organic liquids such as those that are miscible with water e.g. polyhydric alcohols e.g. ethylene glycol, diethylene glycol, trimethylene glycol or trimethylol propane.

The proportion of water in the aqueous liquid in which the oligomer is dissolved or dispersed is at least 40%, preferably at least 75%, more preferably at least 80% by weight.

The oligomer preferably comprises from 2 to 10 repeating units more preferably 3 to 5 and preferably the number of hydrophilic groups in the oligomer is also from 2 to 10.

Because the oligomer contains both hydrophobic and hydrophilic it will have the characteristics of a surfactant.

The hydrophilic groups, which may be anionic, serve to bind the oligomer to the hydrophilic surface thereby rendering the oligomer insoluble.

The hydrophobic group may comprise a non polar hydrocarbon portion of the molecule.

The hydrophilic groups may be acid groups such as carboxylic, sulphonic, sulphate, phosphate or phosphonic acids. Some or all of such acid groups may exist as salts for example those of an alkali metal or ammonium.

The molecular weight of the oligomers is typically in the range from about 500 to about 5000, preferably from about 1000 to about 3000.

The support may be any support suitable for printing plates. Typical supports include metallic and polymeric sheets or foils. The surface of the support may be treated or coated to provide the necessary interaction with the oligomer. Examples of surface coatings include a metallic oxide and gelatin coatings.

Preferably a support having a metallic surface is used. Preferably the metallic surface is oxidized. In a particularly preferred embodiment of the invention a support having an anodized aluminum surface is employed.

Jet velocity, separation length of the droplets, drop size and stream stability are greatly affected by the surface tension and the viscosity of the aqueous composition. Ink-jet inks suitable for use with ink-jet printing systems may have a surface tension in the range from 20 to 60, preferably 30 to 50 dynes/cm. Control of the surface tension in aqueous inks may be accomplished by addition of small amounts of surfactants. The level of surfactants to be used can be determined through simple trial and error experiments. Anionic and non-ionic surfactants may be selected from those disclosed in U.S. Pat. Nos. 5,324,349; 4,156,616; and 5,279,654 as well as many other surfactants known in the ink-jet art. Commercial surfactants include the SURFYNOL brand products (Trade Mark) from Air Products; the ZONYL brand products (Trade Mark) range from DuPont; the FLUORAD brand products (Trade Mark) range from 3M and the AEROSOL brand products (Trade Mark) from Cyanamid. The viscosity of the ink is preferably no greater than 20 centipoise e.g. from 1 to 10, preferably from 1 to 5 centipoise at 20° C.

The emulsion used in the ink-jet printer may comprise other ingredients, for example water-soluble liquids or solids with a substantially higher boiling point than water, e.g. ethanediol, as well as other types of oleophilic precursors such as the sodium salt of oleic acid. A humectant or co-solvent may be included to help prevent the ink from drying out or crusting in the orifices of the print head. A penetrant may also optionally be included to help the ink penetrate the surface of the support. A biocide, such as PROXEL (Trade Mark) GXL biocide from Zeneca Colours may be added to prevent microbial growth which may otherwise occur in the ink over time.

The aqueous emulsion is employed in ink-jet printing wherein drops of the emulsion are applied in a controlled fashion to the surface of the support by ejecting droplets from a plurality of nozzles or orifices in a print head of an ink-jet printer. Commercially available ink-jet printers use several different schemes to control the deposition of the ink droplets. Such schemes are generally of two types: continuous stream or drop-on-demand. In drop-on-demand systems a droplet of ink is ejected from an orifice directly to a position on the ink receptive layer by pressure created by, for example, a piezoelectric device, an acoustic device, or a thermal process controlled in accordance with digital signals. An ink droplet is not generated and ejected through the orifice of the print head unless it is needed. Ink-jet printing methods and related printers are commercially available and need not be described in detail.

The aqueous emulsion may have properties compatible with a wide range of ejecting conditions, e.g. driving voltages, and pulse widths for thermal ink-jet printers, driving frequencies of the piezoelectric element for either a drop-on-demand device or continuous device and the shape and size of the nozzle.

The support for the lithographic printing plate is typically formed of aluminum which has been grained for example by electrochemical graining and then anodized for example by means of anodizing techniques employing sulfuric acid and/or phosphoric acid. Methods of both graining and anodizing are well known in the art.

After writing the image to the printing plate, the printing plate may be inked with printing inking the normal way and the plate used on a printing press. Before inking the plate may be treated with an aqueous solution of natural gum, such as gum acacia or of a synthetic gum such as carboxymethylcellulose, as is known in the art of printing see for example Chapter 10 of "The Lithographer's Manual" edited by Charles Shapiro and published by The Graphic Arts Technical Foundation, Inc. Pittsburgh, Pa. (1966).

Referring to the drawing: from an ink-jet printer head 2 droplets of dispersion (solution or emulsion) 4 are jetted onto a hydrophilic surface 6 of a printing plate 8. The direction of movement of the printing head is indicated by the arrow. A hydrophobic image 10 is produced on the support.

The invention is illustrated by the following Examples.

Preparation 1

Preparation of tetradecylthio'tri(acrylamidoglycolic acid)

The monomer (acrylamidoglycolic acid) (16.3 g, 100 mmol) was dissolved in methanol (200 ml) and purged with nitrogen gas for 15 minutes. The mixture was heated to 62.5° C. and a solution of tetradecylmercaptan (7.68 g, 33.3 mmol) and AIBN (0.24 g) in methanol (50 ml) which had also been purged with nitrogen gas, was added in one portion. The mixture was refluxed under an atmosphere of nitrogen gas for 3 hours. The cooled reaction mixture was washed with heptane (2×150 ml) and solvent removed by evaporation at reduced pressure to give 16.92 g of the water-soluble product with an average of 3 monomer units attached to the thiol.

EXAMPLE 1

A 1 wt % solution in water of the oligomeric surfactant prepared in Preparation 1 above was painted onto a piece of KODAK (Registered Trade Mark) anodised aluminum printing plate using an artist's paintbrush to make an image. The image was allowed to dry naturally and then the plate was wetted with a 0.05 wt % solution of "Viscofas", a proprietary lithographic fountain preparation, using cotton wool. The plate was then lightly rubbed with a small amount of printers ink (BASF Fishburns Minilith Black) on a piece of cotton wool. The image that had been painted on selectively took up the ink, showing a good representation of the painted image with minimal image degradation. The inked image was resistant to firm rubbing.

EXAMPLE 2

In a similar manner a 1 wt % solution in water of the sodium salt of Preparation 2 also showed selective inking of a painted image on a KODAK (Registered Trade Mark) anodised aluminum printing plate.

Preparation 2

Neutralisation of tetradecylthio'tri'(acrylamidoglycolic acid): the trisodium salt of the oligomeric surfactant was prepared by dissolving the above product in water at a concentration of 1 wt % and titrating with aqueous sodium hydroxide using electrochemical detection of the end-point.

EXAMPLE 3

In a similar manner a 1 wt % solution in water of the sodium salt of Preparation 2 also showed selective inking of a painted image on a Kodak (Registered Trade Mark) anodised aluminum printing plate.

Preparation 3

Preparation of octadecylthio'tetra'(2-acrylamido-2-methyl-1-propanesulphonic acid): octadecanethiol (28.66 g, 0.10 mol ) and 2-acrylamido-2-methyl-1-propane sulfonic acid (82.9 g, 0.40 mol ) were stirred together with azobisisobutyronitrile (AIBN) (1.0 g) in methanol (500 ml). The mixture was degassed with argon then refluxed under an argon atmosphere for 18 hours. The reaction mixture still appeared a little cloudy. On cooling a white solid began to form. The mixture was reheated on a steam bath which caused oily globules to appear. The hot solution was filtered under suction on a sinter, trapping the oily globules as a white rubbery solid which failed to dissolve in water, sodium hydroxide or ethyl acetate. The remaining solution on cooling gave another white semicrystalline solid which was filtered off. The remaining solution was washed with heptane (500 ml) and the methanol evaporated to give the product as a white solid (92.4 g).

EXAMPLE 4

In a similar manner a 1 wt % solution in water of the oligomeric product from Preparation 3 also showed selective inking with good quality image resistant to rubbing.

Preparation 4

Preparation of octadecathio'tetra'(2-acrylamido-2-methyl-1-propanesulphonic acid sodium salt). Based on titration results the product from Example 3 (50.00 g, 0.0448 mol) was suspended in water (100 ml) in a round bottom flask and stirred at room temperature. Sodium hydroxide solution (10M, 18.60 ml) was added and the solution warmed to 45° C. for about 15 minutes then allowed to cool while stirring continued (total time 0.5 hours). The resulting pale yellow solution was freeze dried to give the product as a white solid (50.1 g).

EXAMPLE 5

In a similar manner a 1 wt % solution of the oligomeric surfactant from Preparation 4 showed similar behaviour.

Preparation 5

Preparation of Tyloxapol disulphate disodiuum salt. Tyloxapol is a novolak resin comprising an ethoxylated phenol formaldehyde resin.

Tyloxapol (5 g, about 1.3 mmol) was dissolved in 1,2-dichloroethane (100 ml) and chlorosulphonic acid (0.3 g. 2.6 mmol) was added and the mixture heated at 50° C. for 2.5 hours with exclusion of moisture. The mixture was then cooled and solvent evaporated under reduced pressure. Water (100 ml) was and stirred to dissolve. The pH was adjusted to 10 to 11 with aqueous sodium hydroxide and evaporated to dryness on a steam bath. The residue was treated with methanol and the inorganic salts filtered off. The product was isolated by evaporation under reduced pressure and dried under high vacuum.

EXAMPLE 6

The oligomer of Preparation 2 was formulated according to the table to give 20 ml of solution which was placed in an empty clean ink-jet cartridge.

| component | stock solutions (wt %) | vol used in ink (ml) |
|---|---|---|
| oligomer | 1 | 9.6 |
| ethanediol | 15 | 1.4 |
| sorbitol | 5 | 1.0 |
| water | | 8.0 |
| total | | 20.0 |

A standard test-object image was printed onto an Autotype Omega E-Z polyester printing plate using an Epson 200 ink-jet printer, the image allowed to dry and the plate then placed on a printing press (Heidelberg T-Offset) and run using Varn PressMaster Universal Fountain Solution (diluted 1 plus 15) and Van Son Rubber Based Ink-VS310 "Pantone" Black to give clear prints of the test image after rapid ink-up.

EXAMPLE 7

A 0.5% weight aqueous solution of the product of preparation 5 was prepared and the procedure of Example 2 repeated. Again selective inking of the painted area was seen with good quality image.

What is claimed is:

1. A printing plate comprising a hydrophilic support having deposited thereon an image comprising an oligomer containing in the molecule hydrophobic and hydrophilic groups wherein the latter serve to bind it to the support.

2. A method for the preparation of a lithographic printing plate which method comprises forming an oleophilic image on the surface of a hydrophilic support by depositing the image on the surface using an aqueous dispersion of an oligomer having in the molecule both hydrophilic and hydrophobic groups.

3. A method as claimed in claim 2 wherein the oleophilic image is deposited on the surface by ink-jetting.

4. A method as claimed in claim 2 wherein the number of hydrophilic groups in the oligomer is from 2 to 10.

5. A method as claimed in claim 2 wherein the molecular weight of the oligomer is from 500 to 5000.

6. A method as claimed in claim 2 wherein at least one of the hydrohilic groups is an acid group which has been neutralized.

7. A method as claimed in claim 2 wherein the hydrophilic groups are selected from carboxylic, sulphonic or phosphonic acids and the salts thereof.

* * * * *